US011518658B2

(12) United States Patent
Kanda et al.

(10) Patent No.: US 11,518,658 B2
(45) Date of Patent: Dec. 6, 2022

(54) CRANE

(71) Applicant: TADANO LTD., Kagawa (JP)

(72) Inventors: Shinsuke Kanda, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 387 days.

(21) Appl. No.: 16/650,170

(22) PCT Filed: Sep. 28, 2018

(86) PCT No.: PCT/JP2018/036410
§ 371 (c)(1),
(2) Date: Mar. 24, 2020

(87) PCT Pub. No.: WO2019/066016
PCT Pub. Date: Apr. 4, 2019

(65) Prior Publication Data

US 2020/0223670 A1 Jul. 16, 2020

(30) Foreign Application Priority Data

Sep. 29, 2017 (JP) ..... JP2017-192191

(51) Int. Cl.
*B66C 13/06* (2006.01)
*B66C 13/22* (2006.01)
*B66C 23/42* (2006.01)

(52) U.S. Cl.
CPC ..... *B66C 13/063* (2013.01); *B66C 13/22* (2013.01); *B66C 23/42* (2013.01); *B66C 2700/0357* (2013.01)

(58) Field of Classification Search
CPC ..... B66C 13/063; B66C 13/22; B66C 13/46; B66C 13/48
See application file for complete search history.

(56) References Cited

U.S. PATENT DOCUMENTS 8,005,598 B2 * 8/2011 Terashima ..... B66C 13/063 700/55
2008/0275610 A1 * 11/2008 Terashima ..... B66C 13/063 700/55

FOREIGN PATENT DOCUMENTS

JP 2005-067747 A 3/2005
JP 2015-151211 A 8/2015
WO WO 2005/012155 A1 2/2005

OTHER PUBLICATIONS

JP 2005067747A Machine Translation (Year: 2005).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

Provided is a crane that is capable of effectively suppressing oscillation related to the pendulum resonance frequency generated in a suspended load on the basis of the suspended length of a wire rope. The crane 1 calculates a suspended load oscillation resonance frequency ωx(n) determined on the basis of the suspended length L(n) of a wire rope (14·16), and generates a control signal C(n) for an actuator according to an arbitrarily defined operation signal, and, on the basis of the resonance frequency ωx(n), generates from the control signal C(n) a filtering control signal Cd(n) for the actuator in which a frequency component in an arbitrarily defined frequency range is attenuated by an arbitrarily defined percentage. The frequency range of the attenuated frequency component and/or the percentage of attenuation is altered on the basis of the suspended length L(n) of the wire rope (14·16).

6 Claims, 9 Drawing Sheets

(56) References Cited

OTHER PUBLICATIONS

JP 2015151211A Machine Translation (Year: 2015).*
Dec. 11, 2018, International Search Report issued for related PCT Application No. PCT/JP2018/036410.
Dec. 11, 2018, International Search Opinion issued for related PCT Application No. PCT/JP2018/036410.

* cited by examiner

CRANE

CROSS REFERENCE TO PRIOR APPLICATION

This application is a National Stage Patent Application of PCT International Patent Application No. PCT/JP2018/036410 (filed on Sep. 28, 2018) under 35 U.S.C. § 371, which claims priority to Japanese Patent Application No. 2017-192191 (filed on Sep. 29, 2017), which are all hereby incorporated by reference in their entirety.

TECHNICAL FIELD

The present invention relates to cranes. The present invention particularly relates to a crane that attenuates a resonance frequency component of a control signal.

BACKGROUND ART

Conventionally, in cranes, acceleration applied during carriage of a load functions as a vibratory force to cause a vibration in the carried load, in which case the load functions as a simple pendulum being a material point of the load suspended from a leading end of a wire rope or as a double pendulum whose fulcrum is a hook part. Moreover, in a load carried by a crane provided with a telescopic boom, another vibration is caused due to deflection of each structural component of the crane, such as the telescopic boom, a wire rope, or the like besides the vibration caused by the simple pendulum or the double pendulum. The load suspended from the wire rope is carried while vibrating at the resonance frequency of the simple pendulum or the double pendulum and also vibrating at the natural frequencies of the telescopic boom in the luffing direction and/or in the swiveling direction, at the natural frequency of the wire rope during a stretching vibration caused by stretch of the wire rope, and/or the like.

In such a crane, an operator needs to manipulate to cancel out the vibration of the load by swiveling or luffing the telescopic boom manually with a manipulation tool in order to stably lower the load to a predetermined position. For this reason, the carrying efficiency of the crane is affected by the magnitude of the vibration caused during carrying and by the skill level of a crane operator. Accordingly, a crane is known in which the carrying efficiency is enhanced by attenuating a frequency component of the resonance frequency of the load from a speed command (control signal) for an actuator of the crane so as to reduce the vibration of the load. For example, see a crane of Patent Literature (hereinafter, referred to as "PTL") 1).

A crane device described in PTL 1 is a crane device which moves while suspending a load from a wire rope hung down from a trolley. The crane device sets a time delay filter based on a resonance frequency computed based on a suspension length of the wire rope (the length from a suspension position at which the wire rope leaves a sheave to a hook). The crane device can reduce the vibration of the load by moving the trolley by using a corrected trolley speed command which is a trolley speed command to which the time delay filter is applied.

However, the crane device does not consider the length of a sling wire rope coupling the hook at the tip of the wire rope to the load in computing the resonance frequency. In other words, the crane does not consider the length of the sling wire rope for the reason that the distance from the tip of the wire rope to the load is sufficiently small with respect to the suspension length of the wire rope. However, in the technique described in PTL 1, an increase in the ratio of a pendulum length to the suspension length causes a deviation between the resonance frequency computed from the suspension length and the actual resonance frequency, so that it is impossible in some cases to effectively reduce the vibration of the load.

CITATION LIST

Patent Literature

PTL 1
Japanese Patent Application Laid-Open No. 2015-151211

SUMMARY OF INVENTION

Technical Problem

An object of the present invention is to provide a crane that can effectively reduce a vibration that is caused in a load and is related to the resonance frequency of the pendulum based on a suspension length of a wire rope.

Solution to Problem

A crane of the present invention is a crane that: computes a resonance frequency of a swing of a load, the resonance frequency being determined based on a suspension length of a wire rope; and generates a control signal for an actuator according to any manipulation signal, and generates a filtered control signal for the actuator, the filtered control signal being the control signal in which a frequency component in computed frequency range is attenuated with reference to the resonance frequency at computed rate, in which at least one of the frequency range of the frequency component to be attenuated and the rate of attenuation is changed based on the suspension length of the wire rope.

Also provided is a crane that computes a composite frequency resulting from combination of a resonance frequency of a swing of a load based on a suspension length of a wire rope and a natural vibration frequency excited when a structural component constituting the crane is vibrated by an external force; and generates a control signal for an actuator according to any manipulation signal, and generates a filtered control signal for the actuator, the filtered control signal being the control signal in which a frequency component in computed frequency range is attenuated with reference to the composite frequency at computed rate, in which at least one of the frequency range of the frequency component to be attenuated and the rate of attenuation is changed based on the suspension length of the wire rope.

An average value and a minimum value of a length of from a hook position of the wire rope to a position of a center of gravity of the load are obtained based on a past measurement value, a reference resonance frequency of a swing of the load is computed from the suspension length of the wire rope and the average value of the length of from the hook position of the wire rope to the position of the center of gravity of the load, an upper limit resonance frequency of a swing of the load is computed from the suspension length of the wire rope and the minimum value of the length of from the hook position of the wire rope to the position of the center of gravity of the load, and at least one of the frequency range of the frequency component to be attenuated and the rate of attenuation is changed depending on a ratio of the upper limit resonance frequency to the reference resonance frequency.

Advantageous Effects of Invention

According to the present invention, the difference between the resonance frequency computed from the suspension length of the wire rope and the resonance frequency computed from the distance to the position of the center of gravity of the load is estimated from the suspension length of the wire rope, and the frequency range including the resonance frequency computed from the distance to the position of the center of gravity of the load is attenuated. It is thus possible to effectively reduce the vibration that is caused in the load and is related to the resonance frequency of the pendulum based on the suspension length of the wire rope.

According to the present invention, at least one of the frequency range of the frequency component, which is set with reference to the composite frequency of the resonance frequency of the load regarded as a simple pendulum and the natural frequency of the boom, and the rate of attenuation is changed, so that it is possible to reduce not only the swing of the load but also the vibration of the boom. It is thus possible to effectively reduce the vibration that is caused in the load and is related to the resonance frequency of the pendulum based on the suspension length of the wire rope.

According to the present invention, the frequency range of the frequency component to be attenuated and the rate of attenuation are set based on the ratio of the resonance frequency computed for each suspension length of the wire rope from the average value and the minimum value of lengths of from the hook position of the wire rope to the position of the center of gravity of the load. It is thus possible to effectively reduce the vibration that is caused in the load and is related to the resonance frequency of the pendulum based on the suspension length of the wire rope.

BRIEF DESCRIPTION OF DRAWINGS

FIGS. 9A and 9B illustrate swings of the load, in which FIG. 9A illustrates a swing of the load in the case of a small ratio of the average sling length to the suspension length, and FIG. 9B illustrates a swing of the load in the case of a large ratio of the average sling length to the suspension length;

DESCRIPTION OF EMBODIMENT

Hereinafter, a description will be given of crane 1 according to Embodiment 1 of the present invention with reference to FIGS. 1 and 2. Note that, although the present embodiment will be described in relation to a mobile crane (rough terrain crane) as crane 1, crane 1 may also be a truck crane or the like.

Figure 1:
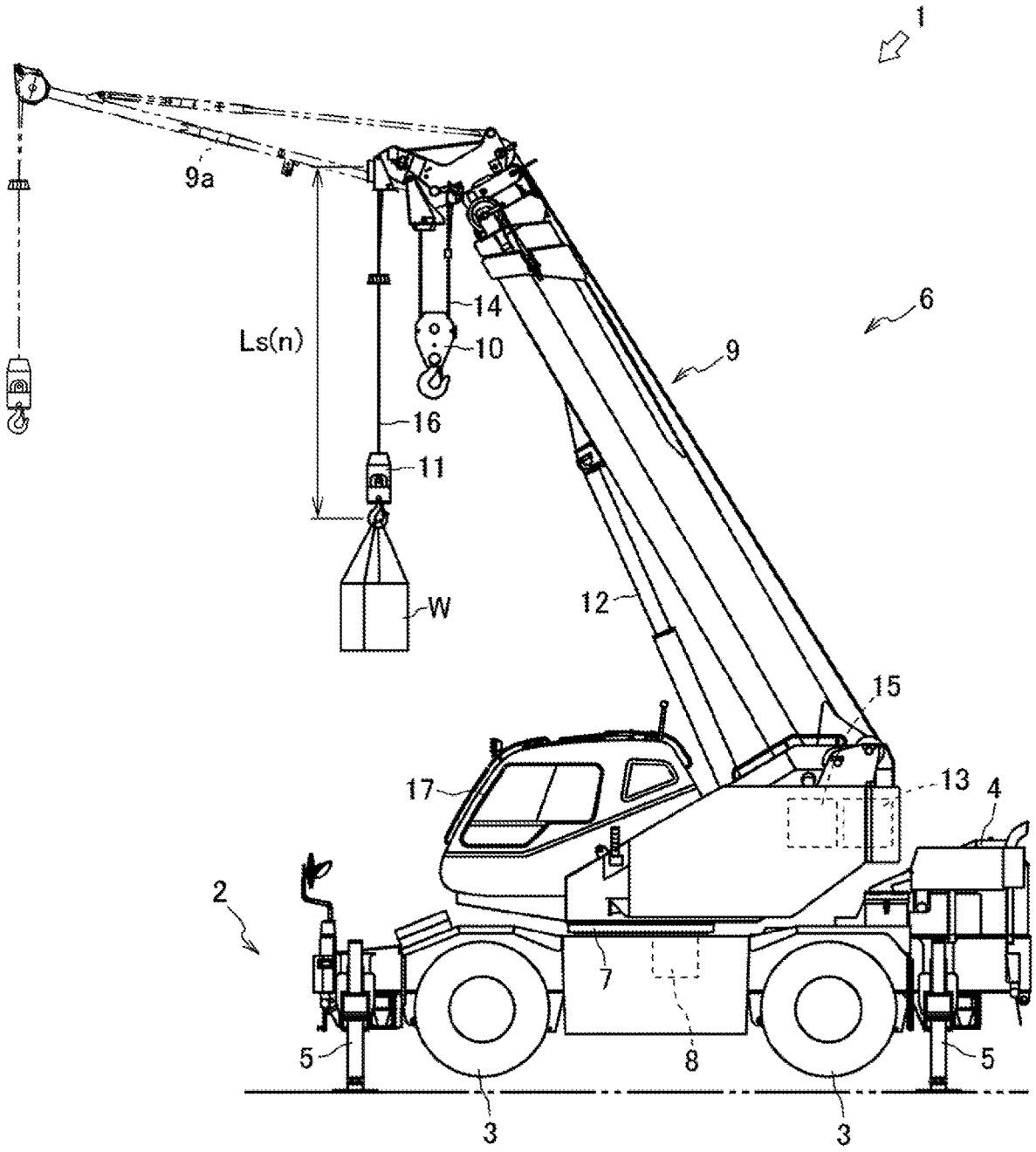
FIG. 1 is a side view illustrating an entire configuration of a crane.

As illustrated in FIG. 1, crane 1 is a mobile crane that can be moved to an unspecified place. Crane 1 includes vehicle 2 and crane device 6.

Vehicle 2 carries crane device 6. Vehicle 2 includes a plurality of wheels 3, and travels using engine 4 as a power source. Vehicle 2 is provided with outriggers 5. Outriggers 5 are composed of projecting beams hydraulically extendable on both sides of vehicle 2 in the width direction and hydraulic jack cylinders extendable in the direction vertical to the ground. Vehicle 2 can extend a workable region of crane 1 by extending outriggers 5 in the width direction of vehicle 2 and bringing the jack cylinders into contact with the ground.

Crane device 6 hoists up load W with a wire rope. Crane device 6 includes swivel base 7, telescopic boom 9, jib 9*a*, main hook block 10, sub hook block 11, hydraulic luffing cylinder 12, main winch 13, main wire rope 14, sub winch 15, sub wire rope 16, cabin 17, and the like.

Swivel base 7 allows crane device 6 to swivel. Swivel base 7 is disposed on a frame of vehicle 2 via an annular bearing. Swivel base 7 is configured to be rotatable around the center of the annular bearing serving as a rotational center. Swivel base 7 is provided with hydraulic swivel motor 8 that is an actuator. Swivel base 7 is configured to swivel in one and the other directions by hydraulic swivel motor 8.

Figure 2:
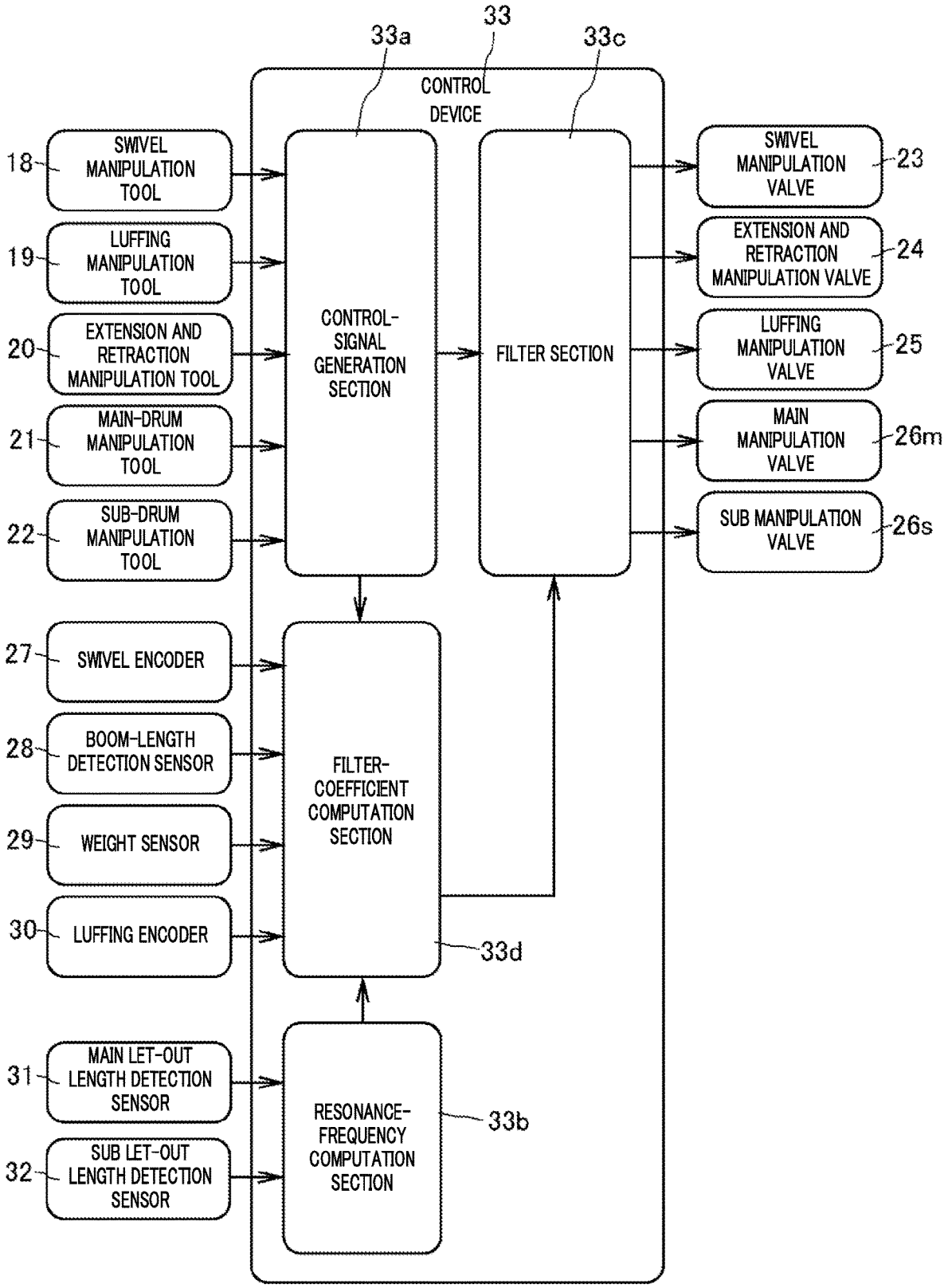
FIG. 2 is a block diagram illustrating a control configuration of the crane.

Hydraulic swivel motor 8 as the actuator is manipulated to rotate by using swivel manipulation valve 23 that is an electromagnetic proportional switching valve (see FIG. 2). Swivel manipulation valve 23 can control the flow rate of the operating oil supplied to hydraulic swivel motor 8 such that the flow rate is any flow rate. That is, swivel base 7 is configured to be controllable via hydraulic swivel motor 8 manipulated to rotate by using swivel manipulation valve 23 such that the swivel speed of swivel base 7 is any swivel speed. Swivel base 7 is provided with swivel encoder 27 (see FIG. 2) that detects the swivel position (angle) and swivel speed of swivel base 7.

Telescopic boom 9 supports the wire rope such that load W can be hoisted. Telescopic boom 9 is composed of a plurality of boom members. Telescopic boom 9 is configured to be extendible and retractable in the axial direction thereof by moving the boom members by a hydraulic extension and retraction cylinder (not illustrated) that is an actuator. The base end of a base boom member of telescopic boom 9 is disposed on a substantial center of swivel base 7 such that telescopic boom 9 is swingable.

The hydraulic extension and retraction cylinder (not illustrated) as the actuator is manipulated to extend and retract by using extension and retraction manipulation valve 24 that is an electromagnetic proportional switching valve (see FIG. 2). Extension and retraction manipulation valve 24 can control the flow rate of the operating oil supplied to the hydraulic extension and retraction cylinder such that the flow rate is any flow rate. That is, telescopic boom 9 is configured to be controllable by extension and retraction manipulation valve 24 such that telescopic boom 9 has any boom length. Telescopic boom 9 is provided with boom-length detection sensor 28 that detects the length of telescopic boom 9 and weight sensor 29 (see FIG. 2) that detects weight Wt of load W.

Jib 9*a* extends the lifting height and the operating radius of crane device 6. Jib 9*a* is held by a jib supporting part disposed in the base boom member of telescopic boom 9 such that the attitude of jib 9*a* is along the base boom member. The base end of jib 9*a* is configured to be able to be coupled to a jib supporting part of a top boom member.

Main hook block 10 and sub hook block 11 are for suspending load W. Main hook block 10 is provided with a plurality of hook sheaves around which main wire rope 14 is wound, and a main hook for suspending load W. Sub hook block 11 is provided with a sub hook for suspending load W.

Hydraulic luffing cylinder 12 as an actuator luffs up or down telescopic boom 9, and holds the attitude of telescopic boom 9. Hydraulic luffing cylinder 12 is composed of a cylinder part and a rod part. In hydraulic luffing cylinder 12, an end of the cylinder part is swingably coupled to swivel base 7, and an end of the rod part is swingably coupled to the base boom member of telescopic boom 9.

Hydraulic luffing cylinder 12 as the actuator is manipulated to extend or retract by using luffing manipulation valve 25 (see FIG. 2) that is an electromagnetic proportional switching valve. Luffing manipulation valve 25 can control the flow rate of the operating oil supplied to hydraulic luffing cylinder 12 such that the flow rate is any flow rate. That is, telescopic boom 9 is configured to be controllable by luffing manipulation valve 25 such that telescopic boom 9 is luffed at any luffing speed. Telescopic boom 9 is provided with luffing encoder 30 (see FIG. 2) that detects the luffing angle of telescopic boom 9.

Main winch 13 and sub winch 15 pulls in (winds up) or lets out (winds out) main wire rope 14 and sub wire rope 16, respectively. Main winch 13 has a configuration in which a main drum around which main wire rope 14 is wound is rotated by using a main hydraulic motor (not illustrated) that is an actuator, and sub winch 15 has a configuration in which a sub drum around which sub wire rope 16 is wound is rotated by using a sub hydraulic motor (not illustrated) that is an actuator.

The main hydraulic motor as the actuator is manipulated to rotate by using main manipulation valve 26*m* (see FIG. 2) that is an electromagnetic proportional switching valve. Main manipulation valve 26*m* can control the flow rate of the operating oil supplied to the main hydraulic motor such that the flow rate is any flow rate. That is, main winch 13 is configured to be controllable by main manipulation valve 26*m* such that the winding-up and letting-out rates are any rates. Similarly, sub winch 15 is configured to be controllable by sub manipulation valve 26*s* (see FIG. 2) that is an electromagnetic proportional switching valve such that the winding-up and letting-out rates are any rates. Main winch 13 is provided with main let-out length detection sensor 31. Similarly, sub winch 15 is provided with sub let-out length detection sensor 32.

Cabin 17 covers an operator compartment. Cabin 17 is mounted on swivel base 7. Cabin 17 is provided with an operator compartment which is not illustrated. The operator compartment is provided with manipulation tools for traveling manipulation of vehicle 2, and swivel manipulation tool 18, luffing manipulation tool 19, extension and retraction manipulation tool 20, main-drum manipulation tool 21, sub-drum manipulation tool 22, and the like for manipulating crane device 6 (see FIG. 2). Swivel manipulation tool 18 can control hydraulic swivel motor 8 by manipulating swivel manipulation valve 23. Luffing manipulation tool 19 can control hydraulic luffing cylinder 12 by manipulating luffing manipulation valve 25. Extension and retraction manipulation tool 20 can control the hydraulic extension and retraction cylinder by manipulating extension and retraction manipulation valve 24. Main-drum manipulation tool 21 can control the main hydraulic motor by manipulating main manipulation valve 26*m*. Sub-drum manipulation tool 22 can control the sub hydraulic motor by manipulating sub manipulation valve 26*s*.

Crane 1 configured as described above is capable of moving crane device 6 to any position by causing vehicle 2 to travel. Crane 1 is also capable of extending the lifting height and/or the operating radius of crane device 6, for example, by luffing up telescopic boom 9 to any luffing angle with hydraulic luffing cylinder 12 by manipulation of luffing manipulation tool 19, and/or by extending telescopic boom 9 to any boom length by manipulation of extension and retraction manipulation tool 20. Crane 1 is also capable of carrying load W by hoisting up load W with sub-drum manipulation tool 22 and/or the like, and causing swivel base 7 to swivel by manipulation of swivel manipulation tool 18.

Control device 33 controls the actuators of crane 1 via the manipulation valves as illustrated in FIG. 2. Control device 33 includes control-signal generation section 33*a*, resonance-frequency computation section 33*b*, filter section 33*c*, and filter-coefficient computation section 33*d*. Control device 33 is provided inside cabin 17. Substantively, control device 33 may have a configuration in which a CPU, ROM, RAM, HDD, and/or the like are connected to one another via a bus, or may be configured to consist of a one-chip LSI or the like. Control device 33 stores therein various programs and/or data in order to control the operation of control-signal generation section 33*a*, resonance-frequency computation section 33*b*, filter section 33*c*, and filter-coefficient computation section 33*d*.

Control-signal generation section 33*a* is a part of control device 33, and generates a control signal that is a speed command for each of the actuators. Control-signal generation section 33*a* is configured to obtain the manipulation amount of each of swivel manipulation tool 18, luffing manipulation tool 19, extension and retraction manipulation tool 20, main-drum manipulation tool 21, sub-drum manipulation tool 22, and the like, and generate control signal C(1) for swivel manipulation tool 18, control signal C(2) for luffing manipulation tool 19, . . . , and/or control signal C(n) (hereinafter, simply generically referred to as "control signal C(n)," where "n" denotes any number). Control-signal generation section 33*a* is also configured to generate control signal C(na) for performing an automatic control (e.g., automatic stop, automatic carriage, or the like) without manipulation of any of the manipulation tools (without any manual control), or control signal C(ne) for performing an emergency stop control based on an emergency stop manipulation of any of the manipulation tools when telescopic boom 9 approaches a restriction area of the working region and/or when control-signal generation section 33*a* obtains a specific command.

Resonance-frequency computation section 33*b* is a part of control device 33, and computes, based on a suspension length of load W and a below-described sling length, resonance frequency ωx(n) that is a pendulum natural frequency of a vibration caused in load W suspended from main wire rope 14 or sub wire rope 16 to function as a simple pendulum (hereinafter, simply referred to as "resonance frequency ωx(n)"). Resonance-frequency computation section 33*b* obtains the luffing angle of telescopic boom 9 obtained by filter-coefficient computation section 33*d*, the let-out amount of corresponding main wire rope 14 or sub wire rope 16 from main let-out length detection sensor 31 or sub let-out length detection sensor 32, and the number of parts of line of main hook block 10 from a safety device (not illustrated) in the case of using main hook block 10.

Further, resonance-frequency computation section 33*b* is configured to compute suspension length Lm(n) of main wire rope 14 from a position (suspension position) in a sheave at which main wire rope 14 leaves the sheave to the hook block or suspension length Ls(n) of sub wire rope 16 from a position (suspension position) in a sheave at which sub wire rope 16 leaves the sheave to the hook block (see FIG. 1) based on the obtained luffing angle of telescopic boom 9, the let-out amount of main wire rope 14 or sub wire rope 16, and the number of parts of line of main hook block 10 in the case of using main hook block 10, and compute resonance frequency $\omega x(n)=\sqrt{(g/L(n))}$ (Equation 1) based on gravitational acceleration g and suspension length L(n) that is suspension length Lm(n) of main wire rope 14 or suspension length Ls(n) of sub wire rope 16.

Filter section 33*c* is a part of control device 33, and generates notch filters Fx(1), Fx(2), . . . , and/or Fx(n) for attenuating specific frequency regions of control signals C(1), C(2), . . . , and/or C(n) (hereinafter, simply referred to as "notch filter Fx(n)," where n is any number) and applies notch filter Fx(n) to control signal C(n). Filter section 33*c* is configured to obtain control signals C(1), C(2), . . . , and/or C(n) from control-signal generation section 33*a*, apply notch filter Fx(1) to control signal C(1) to generate filtered control signal Cd(1) that is control signal C(1) in which a frequency component in any frequency range is attenuated with reference to resonance frequency ω(1) at any rate, apply notch filter Fx(2) to control signal C(2) to generate filtered control signal Cd(2), . . . , and/or apply notch filter Fx(n) to control signal C(n) to generate filtered control signal Cd(n) that is control signal C(n) in which a frequency component in any frequency range is attenuated with reference to resonance frequency ωx(n) at any rate (hereinafter, such filtered control signals are simply referred to as "filtered control signal Cd(n)," where n is any number).

Filter section 33*c* is configured to transmit filtered control signal Cd(n) to a corresponding manipulation valve among swivel manipulation valve 23, extension and retraction manipulation valve 24, luffing manipulation valve 25, main manipulation valve 26*m*, and sub manipulation valve 26*s*. That is, control device 33 is configured to be able to control, via the respective manipulation valves, hydraulic swivel motor 8, hydraulic luffing cylinder 12, the hydraulic extension and retraction cylinder (not illustrated), the main hydraulic motor (not illustrated), and the sub hydraulic motor (not illustrated) that are the actuators.

Figure 5:
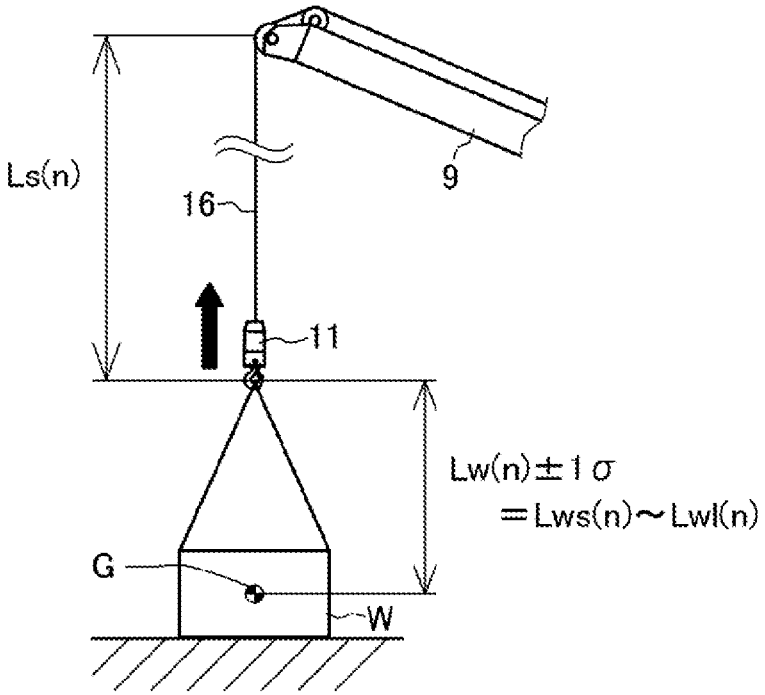
FIG. 5 illustrates a suspension length and a sling length of a load.

Filter-coefficient computation section 33*d* is a part of control device 33, and computes, based on the operational state of crane 1, center frequency coefficient $\omega x_n$, notch width coefficient fix, and notch depth coefficient δx of transfer function H(s) that notch filter Fx(n) has (see Equation 2). Filter-coefficient computation section 33*d* is configured to compute center frequency coefficient $\omega x_n$ corresponding to obtained resonance frequency ωx(n). Filter-coefficient computation section 33*d* is also configured to compute notch width coefficient ζx and notch depth coefficient δx of notch filter Fx(n) based on suspension length Lm(n) of main wire rope 14 or suspension length Ls(n) of sub wire rope 16 (see FIG. 5).

Notch filter Fx(n) will be described with reference to FIGS. 3 and 4. Notch filter Fx(n) is a filter for giving steep attenuation to control signal C(n) with respect to any center frequency.

Figure 3:
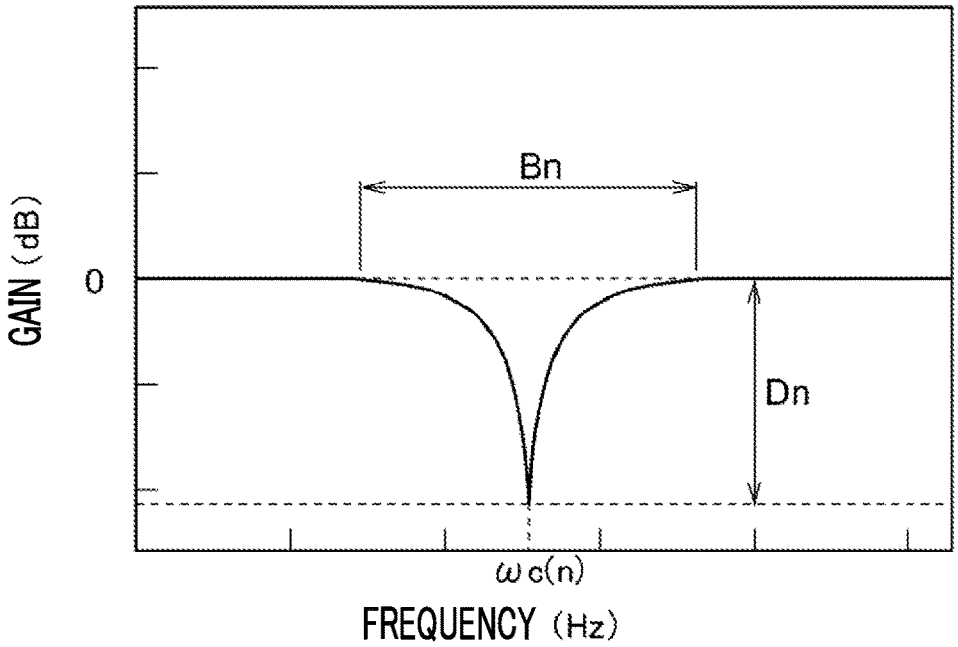
FIG. 3 illustrates a graph indicating frequency characteristics of a notch filter.

As illustrated in FIG. 3, notch filter Fx(n) is a filter having frequency characteristics by which a frequency component in notch width Bn that is any frequency range centrally including any center frequency ωc(n) is attenuated at notch depth Dn that is a rate of attenuation of any frequency at center frequency ωc(n). That is, the frequency characteristics of notch filter Fx(n) are set based on center frequency ωc(n), notch width Bn, and notch depth Dn.

Notch filter Fx(n) has transfer function H(s) indicated by following Equation 2.

[1]

(Equation 2)

$$H(s) = \frac{s^2 + 2\delta x\zeta x\omega x_n s + \omega x_n^2}{s^2 + 2\zeta x\omega x_n s + \omega x_n^2} \tag{2}$$

In Equation 2, "$\omega_n$" denotes center frequency coefficient $\omega x_n$ corresponding to center frequency ωc(n) of notch filter Fx(n), "ζa" denotes the notch width coefficient corresponding to notch width Bn, and "δa" denotes the notch depth coefficient corresponding to notch depth Dn. In notch filter Fx(n), changing center frequency coefficient $\omega x_n$ changes center frequency ωc(n) of notch filter Fx(n), changing notch width coefficient ζx changes notch width Bn of notch filter Fx(n), and changing notch depth coefficient δx changes notch depth Dn of notch filter Fx(n).

The greater notch width coefficient is set, the greater the notch width Bn is set. Accordingly, in an input signal to which notch filter Fx(n) is applied, the attenuated frequency range with respect to center frequency ωc(n) is set by notch width coefficient ζx.

Notch depth coefficient δx is set between 0 to 1.

Figure 4:
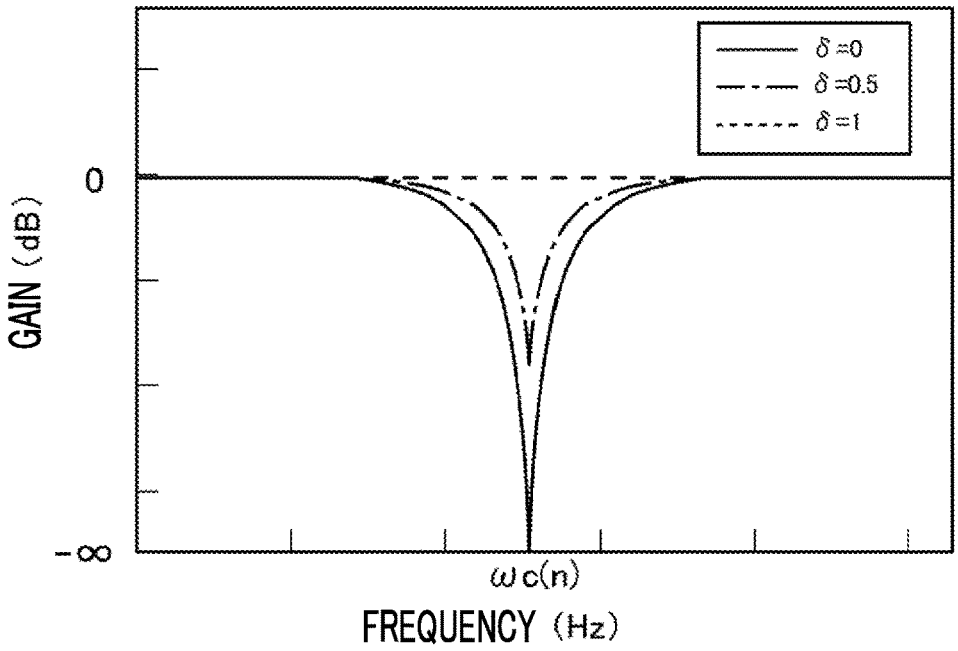
FIG. 4 illustrates a graph indicating frequency characteristics of the notch filter with different notch depth coefficients.

As illustrated in FIG. 4, notch filter Fx(n) achieves a gain characteristic of −∞dB at center frequency ωc(n) of notch filter Fx(n) in the case of notch depth coefficient δx=0. Notch filter Fx(n) thus achieves the greatest attenuation at center frequency ωc(n) in the input signal to which notch filter Fx(n) is applied. That is, notch filter Fx(n) outputs the input signal while maximizing the attenuation in the input signal in accordance with the frequency characteristics of notch filter Fx(n).

Notch filter Fx(n) achieves a gain characteristic of 0 dB at center frequency ωc(n) of notch filter Fx(n) in the case of notch depth coefficient δx=1. Notch filter Fx(n) thus does not attenuate any frequency component of the input signal to which notch filter Fx(n) is applied. That is, notch filter Fx(n) outputs the input signal as input.

As illustrated in FIG. 2, control-signal generation section 33*a* of control device 33 is connected to swivel manipulation tool 18, luffing manipulation tool 19, extension and retraction manipulation tool 20, main-drum manipulation tool 21, and sub-drum manipulation tool 22, and can generate control signal C(n) according to the manipulation amount (manipulation signal) of each of swivel manipulation tool 18, luffing manipulation tool 19, main-drum manipulation tool 21, and sub-drum manipulation tool 22.

Resonance-frequency computation section 33*b* of control device 33 is connected to main let-out length detection sensor 31, sub let-out length detection sensor 32, and filter-coefficient computation section 33*d*, so as to be capable of obtaining suspension length Lm(n) of main wire rope 14 or suspension length Ls(n) of sub wire rope 16.

Filter section 33*c* of control device 33 is connected to swivel manipulation valve 23, extension and retraction manipulation valve 24, luffing manipulation valve 25, main manipulation valve 26*m*, and sub manipulation valve 26*s*, and can transmit filtered control signal Cd(n) corresponding to each of swivel manipulation valve 23, extension and retraction manipulation valve 24, luffing manipulation valve 25, main manipulation valve 26*m*, and sub manipulation valve 26*s*. Filter section 33*c* is also connected to control-signal generation section 33*a*, so as to be capable of obtaining control signal C(n). Filter section 33*c* is also connected to filter-coefficient computation section 33*d*, so as to be capable of obtaining notch width coefficient $\zeta x$, notch depth coefficient $\delta x$, and center frequency coefficient $\omega x_n$.

Filter-coefficient computation section 33*d* of control device 33 is connected to swivel encoder 27, boom-length detection sensor 28, weight sensor 29, and luffing encoder 30, so as to be capable of obtaining the swivel position of swivel base 7, the boom length, and the luffing angle, and weight Wt of load W. Filter-coefficient computation section 33*d* is also connected to control-signal generation section 33*a*, so as to be capable of obtaining control signal C(n). Filter-coefficient computation section 33*d* is also connected to resonance-frequency computation section 33*b*, so as to be capable of obtaining suspension length Lm(n) of main wire rope 14, suspension length Ls(n) of sub wire rope 16 (see FIG. 1), and resonance frequency $\omega x(n)$.

Control device 33 generates, at control-signal generation section 33*a*, control signal C(n) corresponding to each of swivel manipulation tool 18, luffing manipulation tool 19, extension and retraction manipulation tool 20, main-drum manipulation tool 21, and sub-drum manipulation tool 22 based on the manipulation amount of the manipulation tool. Further, control device 33 computes, at resonance-frequency computation section 33*b*, resonance frequency $\omega x(n)$ based on the sum of suspension length Lm(n) of main wire rope 14 or suspension length Ls(n) of sub wire rope 16 and the below-described sling length. Control device 33 also computes, at filter-coefficient computation section 33*d*, corresponding center frequency coefficient $\omega x_n$, with resonance frequency $\omega x(n)$ computed at resonance-frequency computation section 33*b* being used as center frequency $\omega c(n)$ of notch filter Fx(n). Moreover, control device 33 computes, at filter-coefficient computation section 33*d*, notch width coefficient and notch depth coefficient $\delta x$ of notch filter Fx(n) based on the sum of suspension length Lm(n) of main wire rope 14 or suspension length Ls(n) of sub wire rope 16 and the below-described sling length.

Figure 6:
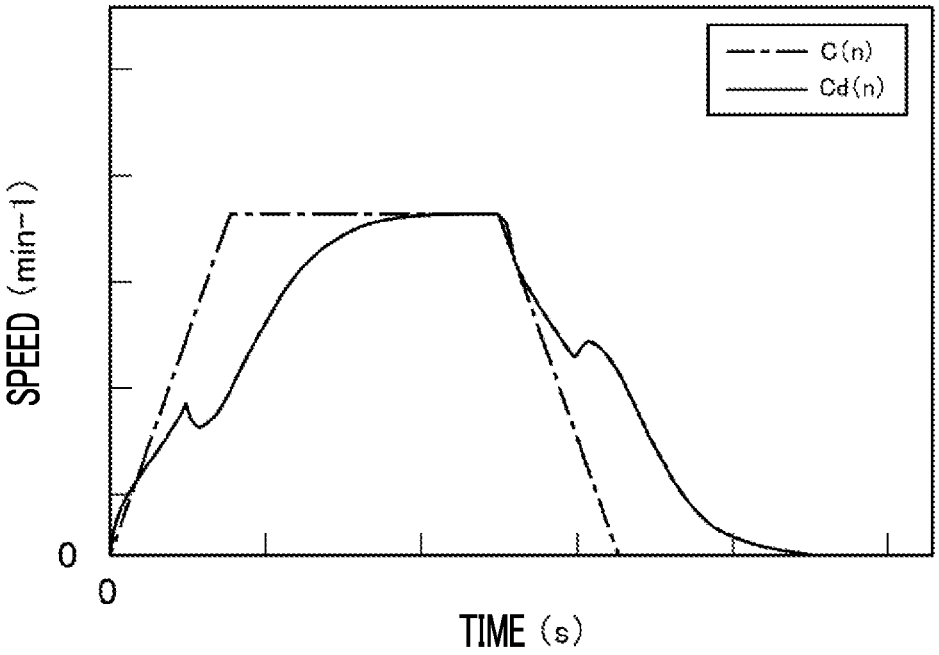
FIG. 6 illustrates a graph indicating a control signal for a swivel manipulation and a filtered control signal to which the notch filter is applied.

As illustrated in FIG. 6, control device 33 generates filtered control signal Cd(n) at filter section 33*c* by applying, to control signal C(n), notch filter Fx(n) in which notch width coefficient $\zeta x$, notch depth coefficient $\delta x$, and center frequency coefficient $\omega x_n$ are applied. Since the frequency component of resonance frequency $\omega x(n)$ is attenuated in filtered control signal Cd(n) to which notch filter Fx(n) is applied, filtered control signal Cd(n) exhibits a slower rise than control signal C(n) does and the time taken for operation to be finished is greater in the case of filtered control signal Cd(n) than in the case of control signal C(n). In other words, in any of the actuators controlled by filtered control signal Cd(n) to which notch filter Fx(n) with notch depth coefficient $\delta x$ close to 0 (notch depth Dn is deep) is applied, the operational reaction in response to manipulation of the manipulation tool is slower and the manipulability is lower than in a case where the actuator is controlled by filtered control signal Cd(n) to which notch filter Fx(n) with notch depth coefficient $\delta x$ close to 1 (notch depth Dn is shallow) is applied, or in a case where the actuator is controlled by control signal C(n) to which notch filter Fx(n) is not applied.

Similarly, in any of the actuators controlled by filtered control signal Cd(n) to which notch filter Fx(n) with notch width coefficient $\zeta x$ being relatively greater than a standard value (notch width Bn is relatively great) is applied, the operational reaction in response to manipulation of the manipulation tool is slower and the manipulability is lower than in a case where the actuator is controlled by filtered control signal Cd(n) to which notch filter Fx(n) with notch width coefficient being relatively smaller than the standard value (notch width Bn is relatively narrow) is applied, or in the case where the actuator is controlled by control signal C(n) to which notch filter Fx(n) is not applied.

Next, with reference to FIG. 7, a description will be given of computation of notch width coefficient and notch depth coefficient $\delta x$ of notch filter Fx(n) based on suspension length Lm(n) of main wire rope 14 or suspension length Ls(n) of sub wire rope 16. Note that, the description will be given on the assumption that crane 1 suspends load W by using sub wire rope 16.

Figure 7:
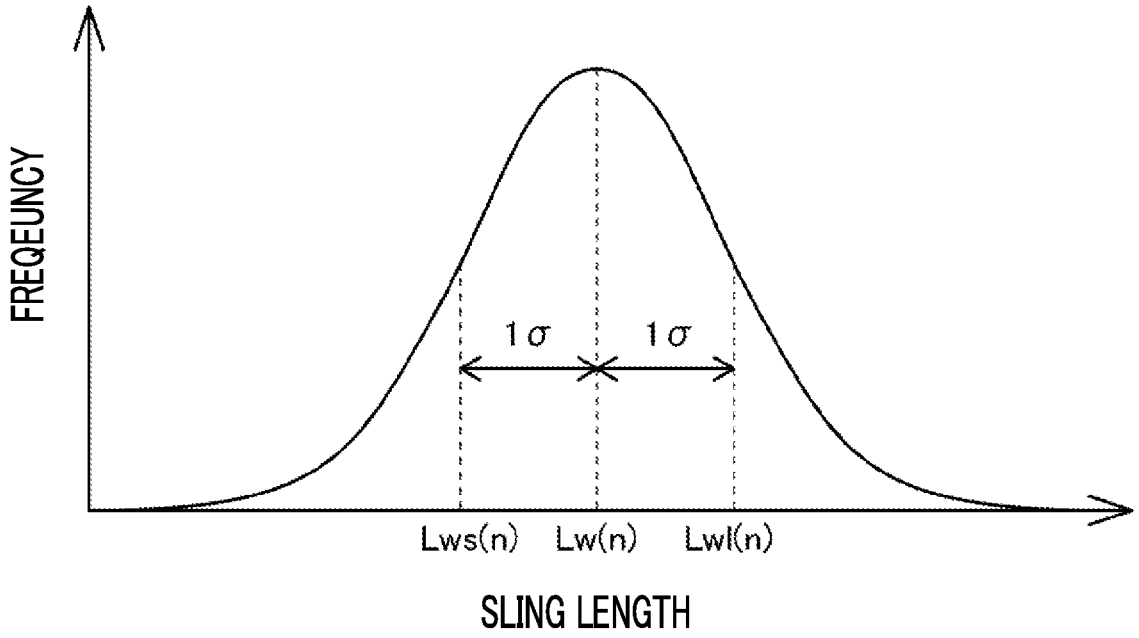
FIG. 7 illustrates a distribution of sling lengths measured in the past.

As illustrated in FIG. 7, a suspending length of from the sub hook to the upper surface of load W suspended by a sling wire rope and the length of from the upper surface of load W to the center of gravity added together (hereinafter, simply referred to as "sling length") follow a normal distribution. In other words, the sling length is distributed in the range of from longest sling length Lwl(n) that is longer by standard deviation 6 than average sling length Lw(n) as a median value to shortest sling length Lws(n) that is shorter by standard deviation 6 than average sling length Lw(n). Accordingly, letting reference resonance frequency $\omega xs(n)$ that is computed from the sum of suspension length Ls(n) of sub wire rope 16 and average sling length Lw(n) serve as the median value, the resonance frequency of load W swinging as a simple pendulum varies within the range of from lower limit resonance frequency $\omega xl(n)$ for the case of longest sling length Lwl(n) to upper limit resonance frequency $\omega xh(n)$ for the case of shortest sling length Lws(n). Lower limit resonance frequency $\omega xl(n)$, reference resonance frequency $\omega xs(n)$, and upper limit resonance frequency $\omega xh(n)$ increase as suspension length Ls(n) decreases. The rate of increase in upper limit resonance frequency $\omega xh(n)$ with respect to the change in suspension length Ls(n) is greater than the rate of increase in lower limit resonance frequency $\omega xl(n)$.

Figure 8:
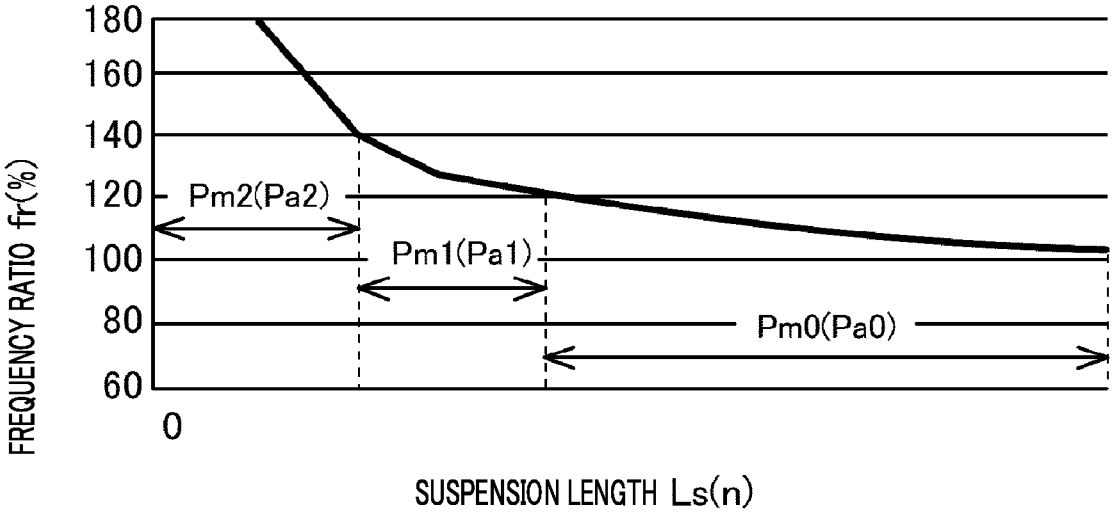
FIG. 8 is a graph illustrating a relationship between a frequency ratio, on the one hand, and an average sling length and a shortest sling length, on the other hand, for each suspension length.

As illustrated in FIG. 8, frequency ratio fr of upper limit resonance frequency $\omega xh(n)$ to reference resonance frequency $\omega xs(n)$ for each sum of suspension length Ls(n) of sub wire rope 16 and average sling length Lw(n) (frequency ratio fr=upper limit resonance frequency $\omega xh(n)$/reference resonance frequency $\omega xs(n)$) increases as suspension length Ls(n) decreases. That is, the difference between reference resonance frequency $\omega xs(n)$ and upper limit resonance frequency $\omega xh(n)$ increases as suspension length Ls(n) decreases. Thus, the difference between reference resonance frequency $\omega xs(n)$ and upper limit resonance frequency $\omega xh(n)$ increases as frequency ratio fr increases. Therefore, by setting notch width coefficient $\zeta x$ and notch depth coefficient $\delta x$ such that notch width Bn of notch filter Fx(n) becomes wider and notch depth Dn becomes shallower as frequency ratio fr increases, the vibration can be absorbed even when there is a difference between reference resonance frequency ωxs(n) and upper limit resonance frequency ωxh(n).

Control device 33 stores average sling length Lw(n), longest sling length Lwl(n), and shortest sling length Lws(n) in advance. Control device 33 also stores a parameter that is a combination of notch width coefficient and notch depth coefficient δx for each range of frequency ratio fr. For example, for the manual control or the like in which manipulability of a manipulation tool is to be prioritized, control device 33 stores parameter Pm0 for the range of frequency ratio fr of 100% or more and less than 120%, parameter Pm1 for the range of frequency ratio fr of 120% or more and less than 140%, parameter Pm2 for the range of frequency ratio fr of 140% or more. Parameters Pm0, Pm1, and Pm2 are set such that an inertially-driven amount caused when notch filter Fx(n) is applied is substantially the same for same suspension length Ls(n). Further, for the automatic control or the like in which reduction in the swing of load W is to be prioritized, control device 33 stores parameter Pa0 for the range of frequency ratio fr of 100% or more and less than 120%, parameter Pa1 for the range of frequency ratio fr of 120% or more and less than 140%, parameter Pa2 for the range of frequency ratio fr of 140% or more.

In the same range of frequency ratio fr, notch depth coefficient δx of parameter Pm0, Pm1, or Pm2 for prioritizing the manipulability of the manipulation tool is set smaller than notch depth coefficient δx of parameter Pa0, Pa1, or Pa2 for prioritizing reduction in the swing of load W. That is, in the same range of frequency ratio fr, notch filter Fx(n) in which one of parameters Pm0, Pm1, and Pm2 for prioritizing the manipulability of the manipulation tool is applied has notch depth Dn that is shallower than that of notch filter Fx(n) to which one of parameters Pa0, Pa1, and Pa2 for prioritizing reduction in the swing of load W is applied. Control device 33 configured as described above is capable of switching the characteristics of notch filter Fx(n) between the case of the manual control in which maintaining the manipulability of the manipulation tool is to be prioritized and the case in which reduction in the swing of load W is to be prioritized.

Filter-coefficient computation section 33*d* of control device 33 computes frequency ratio fr of upper limit resonance frequency ωxh(n) to reference resonance frequency ωxs(n) based on suspension length Ls(n). In the case of the manual control, filter-coefficient computation section 33*d* selects a parameter corresponding to a band including computed frequency ratio fr from among parameters Pm0, Pm1, and Pm2. In the case of the automatic control, filter-coefficient computation section 33*d* selects a parameter corresponding to a band including computed frequency ratio fr from among parameters Pa0, Pa1, and Pa2.

Filter section 33*c* of control device 33 generates filtered control signal Cd(n) by applying, to control signal C(n), notch filter Fx(n) in which notch width coefficient and notch depth coefficient δx of the computed parameter and center frequency coefficient $\omega x_n$ are applied.

As illustrated in FIG. 6, the frequency component of resonance frequency ωx(n) is attenuated in filtered control signal Cd(n) to which notch filter Fx(n) is applied by filter section 33*c* of control device 33, so that filtered control signal Cd(n) exhibits a slower rise than control signal C(n) does and the time taken for operation to be finished is greater in the case of filtered control signal Cd(n) than in the case of control signal C(n). In other words, in any of the actuators controlled using filtered control signal Cd(n) to which notch filter Fx(n) with notch depth coefficient δx close to 0 (notch depth Dn is deep) is applied, the operational reaction in response to manipulation of the manipulation tool is slower and the manipulability is lower than in a case where the actuator is controlled by filtered control signal Cd(n) to which notch filter Fx(n) with notch depth coefficient δx close to 1 (notch depth Dn is shallow) is applied, or in a case where the actuator is controlled by control signal C(n) to which notch filter Fx(n) is not applied.

Figure 9A:
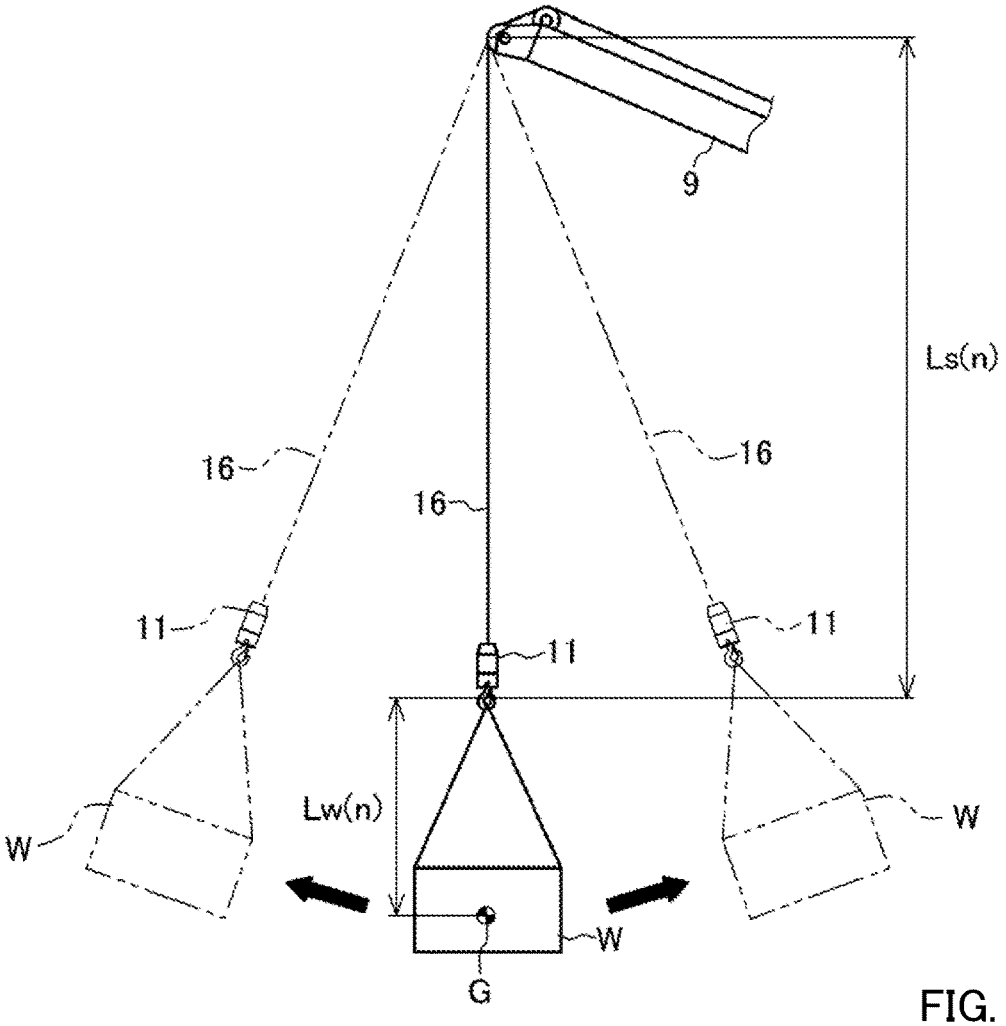
Figure 9B:
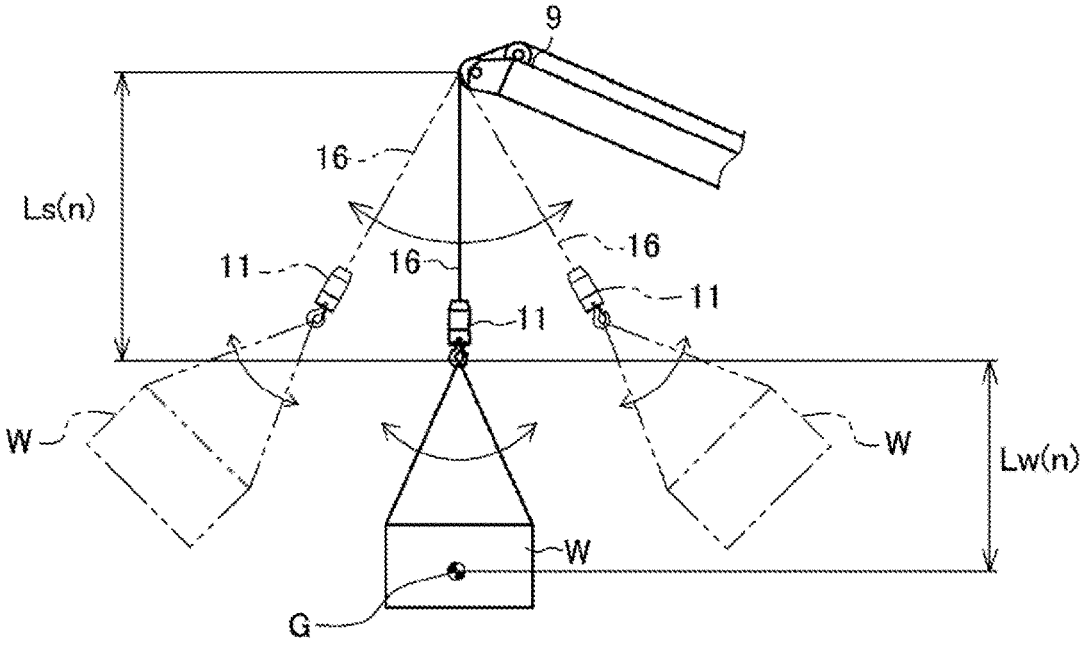

Further, as illustrated in FIGS. 9A and 9B, in crane 1, load W is slung from the hook block (main hook block 10 or sub hook block 11) corresponding to the wire rope (main wire rope 14 or sub wire rope 16) using the sling wire rope. Thus, strictly speaking, the hook block and load W function as a double pendulum to move back and forth.

As illustrated in FIG. 9A, when the ratio of average sling length Lw(n) to suspension length Ls(n) is close to zero, load W can be regarded as a simple pendulum. Therefore, control device 33 sets the parameters such that notch width Bn and notch depth Dn of notch filter Fx(n) whose center frequency ωc(n) is resonance frequency ωx(n) computed from suspension length L(n) respectively become narrower and deeper as frequency ratio fr decreases.

As illustrated in FIG. 9B, when the ratio of average sling length Lw(n) to suspension length Ls(n) is close to 1, the characteristics as a double pendulum are exhibited more strongly, and the difference between resonance frequency ωx(n) computed from suspension length L(n) and resonance frequency ωx(n) computed from the distance to center of gravity G that is the position of the center of gravity of load W is large. Therefore, control device 33 sets the parameters such that notch width Bn and notch depth Dn of notch filter Fx(n) whose center frequency ωc(n) is resonance frequency ωx(n) computed from suspension length L(n) respectively become wider and shallower.

As described above, control device 33 sets the frequency range and the ratio of attenuation of notch filter Fx(n) based on frequency ratio fr, so that it is possible to reduce the vibration of load W even when the characteristics as a double pendulum are strongly exhibited.

Next, a description will be given of a vibration control of control device 33 based on the operational state of crane 1. In the below-described embodiment, when crane 1 is operated manually by manipulation of any of swivel manipulation tool 18, luffing manipulation tool 19, extension and retraction manipulation tool 20, main-drum manipulation tool 21, and sub-drum manipulation tool 22 (hereinafter, simply referred to as the "manipulation tool") and when control device 33 obtains control signal C(n) generated based on a single manipulation tool from control-signal generation section 33*a*, control device 33 sets notch filter Fx(n). Control device 33 computes center frequency coefficient $\omega x_n$, with resonance frequency ωx(n) computed at resonance-frequency computation section 33*b* being used as reference center frequency ωc(n) of notch filter Fx(n). In addition, control device 33 sets at least one of notch depth coefficient δx and notch width coefficient ζx of notch filter Fx(n).

In the case of the manual control in which the manipulability of the manipulation tool is to be prioritized, control device 33 computes reference resonance frequency ωxs(n) and upper limit resonance frequency ωxh(n) from average sling length Lw(n) and shortest sling length Lws(n) stored in advance, and from obtained suspension length Ls(n). The control device computes frequency ratio fr from reference resonance frequency ωxs(n) and upper limit resonance frequency ωxh(n). Control device 33 computes the parameter corresponding to computed frequency ratio fr from among parameters Pm0, Pm1, and Pm2. Control device 33 sets notch filter Fx(n1) by applying notch width coefficient ζx and notch depth coefficient δx of the computed parameter to transfer function H(s). Accordingly, crane 1 applies notch filter Fx(n1) that takes into account an error due to average sling length Lw(n) while prioritizing to maintain the manipulability of the manipulation tool.

In contrast, in the case of the automatic control in which the vibration reducing effect is to be prioritized, control device 33 computes the parameter corresponding to computed frequency ratio fr from among parameters Pa0, Pa1, and Pa2. Control device 33 sets notch filter Fx(n2) by applying notch width coefficient ζx and notch depth coefficient δx of the computed parameter to transfer function H(s). Accordingly, crane 1 applies notch filter Fx(n2) that takes into account an error due to average sling length Lw(n) while prioritizing the effect of reducing the vibration at resonance frequency ωx(n) of load W.

In the present embodiment, when control device 33 obtains from control-signal generation section 33*a* control signal C(n) generated based on a single manipulation tool, control device 33 generates filtered control signal Cd(n1) by applying to control signal C(n) notch filter Fx(n1) in which notch depth coefficient δx of one of parameters Pm0, Pm1, and Pm2 according to computed frequency ratio fr is set in order to prioritize the manipulability of the manipulation tool.

In the case of the manual control in which a single manipulation tool is being manipulated alone, and during this manipulation, another manipulation tool is further manipulated, control device 33 applies notch filter Fx(n2) instead of notch filter Fx(n1) to control signal C(n) according to the single manipulation tool and control signal C(n+1) according to the other manipulation tool, so as to generate filtered control signal Cd(n2) and filtered control signal Cd(n2+1) in order to prioritize the vibration reducing effect, when obtaining control signal C(n+1) generated based on manipulation of the other manipulation tool from control-signal generation section 33*a*. Further, when the manipulation is changed to manipulation with a single manipulation tool alone, control device 33 switches from notch filter Fx(n2) to notch filter Fx(n1) in order to prioritize the manipulability of the manipulation tool, and applies notch filter Fx(n1) to control signal C(n) according to the single manipulation tool to generate filtered control signal Cd(n1).

For example, in manipulation with a remote manipulation device or the like, it is probable that, when the manipulation amount of a single manipulation tool is applied as the manipulation amount of another manipulation tool, a variation amount per unit time (acceleration) of control signal C(n+1) of the other manipulation tool may become significantly greater. Specifically, in a case where an ON/OFF switch of the swivel manipulation, an ON/OFF switch of the luffing manipulation, and a common speed lever for setting the speed of both of the manipulations are provided, and when the ON/OFF switch of the swivel manipulation is turned on and the luffing switch is turned on during the swivel operation being performed at any speed, the speed setting for the swivel operation is applied for the luffing manipulation. That is, it is probable that a large vibration may arise when manipulation is started with a plurality of manipulation tools. For this reason, when a single manipulation tool is manipulated alone and, during this manipulation, another manipulation tool is further operated, notch filter Fx(n) is switched for prioritization of the vibration reducing effect.

Crane 1 can thus apply notch filter Fx(n1) to generate filtered control signal Cd(n1) for prioritizing to maintain the manipulability of the manipulation tool when a single manipulation tool is manipulated alone. Moreover, in the case of manipulation to use a plurality of manipulation tools in combination by which a vibration is easily caused, crane 1 can apply notch filter Fx(n2) to generate filtered control signal Cd(n2) and filtered control signal Cd(n2+1) for prioritizing the vibration reducing effect for the manipulation tools.

In addition, in a case where crane 1 is operated under the automatic control such as automatic stop to be performed before crane 1 reaches an operation restriction area, automatic carriage, or the like, and when filter-coefficient computation section 33*d* obtains from control-signal generation section 33*a* control signal C(na) which is not based on manipulation of any of the manipulation tools, control device 33 applies notch filter Fx(n2) to control signal C(na) so as to generate filtered control signal Cd(na2) for prioritizing the vibration reduction effect for the manipulation tools.

For example, in a case where any limitation and/or any stop position are set because of restrictions of a working region and load W enters such a working region, crane 1 operates not by manipulation of any of the manipulation tools but based on control signal C(na) of the automatic control. Also in a case where an automatic carriage mode is set for crane 1, crane 1 operates based on control signal C(na) of the automatic control for carrying a predetermined load along a predetermined carrying path at a predetermined carrying speed at a predetermined carrying height for the predetermined load. That is, since crane 1 is manipulated not by an operator but under the automatic control, it is unnecessary to prioritize the manipulability of the manipulation tool. Accordingly, control device 33 applies notch filter Fx(n2) to control signal C(na) so as to generate filtered control signal Cd(na2) in order to prioritize the vibration reducing effect. Crane 1 can thus enhance the effect of reducing the vibration of load W at resonance frequency ωx(n). That is, crane 1 can generate filtered control signal Cd(na2) for prioritizing the vibration reducing effect in the automatic control.

In addition, when the emergency stop manipulation by manually manipulating a specific manipulation tool or the emergency stop manipulation with a manipulation tool in a specific manipulation procedure is carried out, control device 33 does not apply notch filter Fx(n) to control signal C(ne) generated based on the emergency stop manipulation of any of the manipulation tools.

For example, when the emergency stop manipulation for bringing all the manipulation tools back to neutral states at once is performed in order to immediately stop swivel base 7 and telescopic boom 9 of crane 1, control device 33 determines that specific manual manipulation is performed and does not apply notch filter Fx(n) to control signal C(ne) generated based on the emergency stop manipulation of the manipulation tools. Accordingly, maintaining the manipulability of the manipulation tools is prioritized in crane 1 and swivel base 7 and telescopic boom 9 are immediately stopped without any delay. That is, crane 1 does not carry out the vibration control in the emergency stop manipulation of the manipulation tools.

The vibration control of control device 33 based on the operational state of crane 1 will be specifically described below with reference to FIGS. 10 and 11. The description will be given on the assumption that control device 33 obtains suspension length Ls(n) from sub let-out length detection sensor 32, and stores average sling length Lw(n), longest sling length Lwl(n), and shortest sling length Lws(n) in advance. The description is given also on the assumption that control device 33 generates, at control-signal generation section 33*a* at each scan time, control signal C(n) that is a speed command for any of swivel manipulation tool 18, luffing manipulation tool 19, extension/retraction manipulation tool 20, main-drum manipulation tool 21, and sub-drum manipulation tool 22 based on the manipulation amount of the manipulation tool. The description will be given on the supposition that at least one of control signal C(n) according to manipulation of a single manipulation tool, control signal C(n+1) according to manipulation of another manipulation tool, and control signal C(ne) for emergency manipulation to be generated by emergency stop manipulation of a manipulation tool is generated according to the manipulation state of manipulation tools in crane 1.

Figure 10:
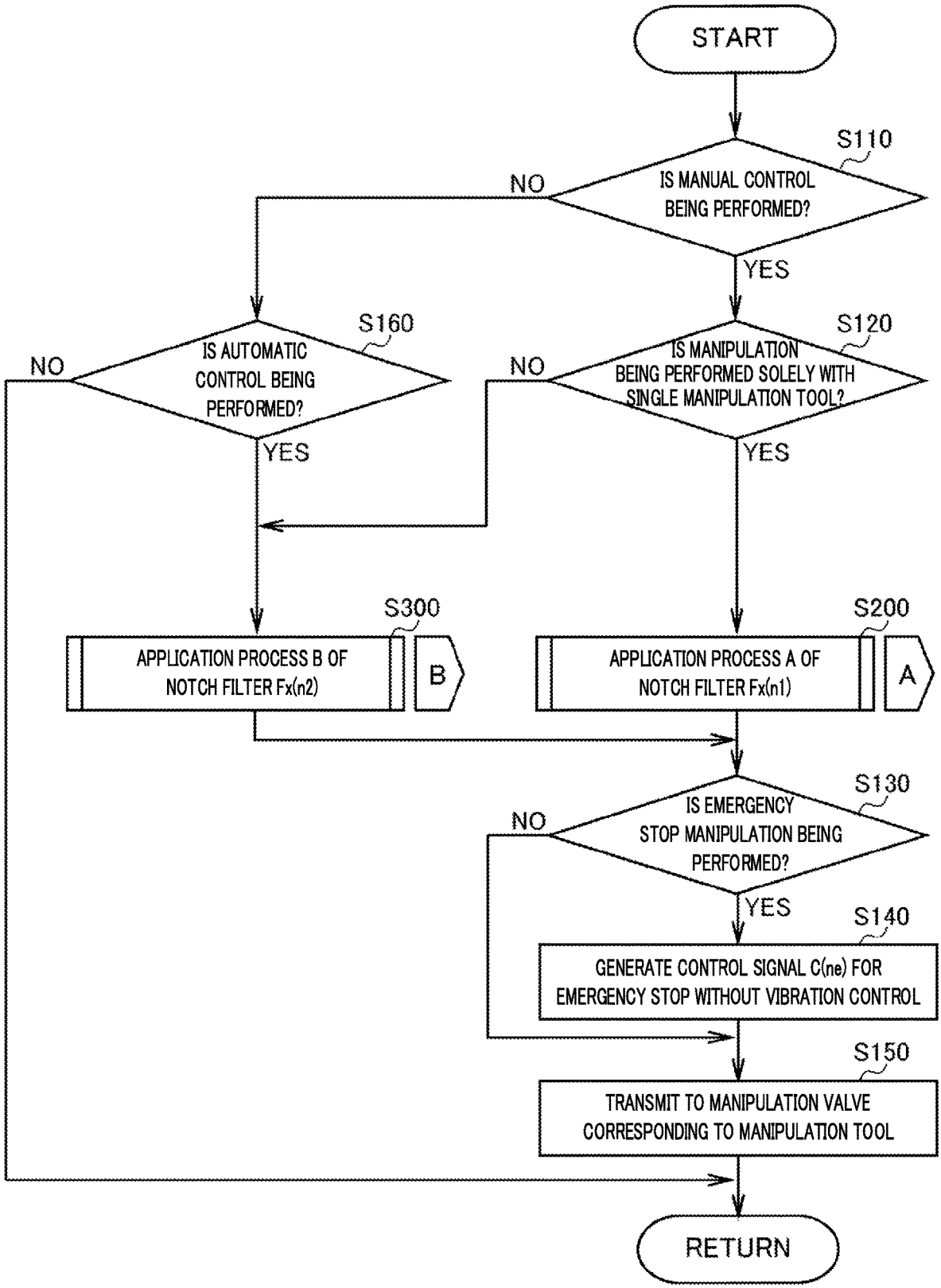
FIG. 10 is a flowchart indicating a control mode of an entire vibration control.

As illustrated in FIG. 10, control device 33 determines at step S110 of the vibration control whether or not the manual control in which a manipulation tool is manipulated is being carried out.

When a result of the determination indicates that the manual control in which the manipulation tool is manipulated is being carried out, control device 33 proceeds to step S120.

On the other hand, when the manual control in which the manipulation tool is manipulated is not being carried out, control device 33 proceeds to step S160.

At step S120, control device 33 determines whether or not a single manipulation tool is being manipulated.

When a result of the determination indicates that the single manipulation tool is being manipulated (that is, when a single actuator is being controlled by manipulation of the single manipulation tool), control device 33 proceeds to step S200.

On the other hand, when the manipulation is not only by the single manipulation tool (that is, when a plurality of actuators are being controlled by manipulation of a plurality of manipulation tools), control device 33 proceeds to step S300.

Figure 11:
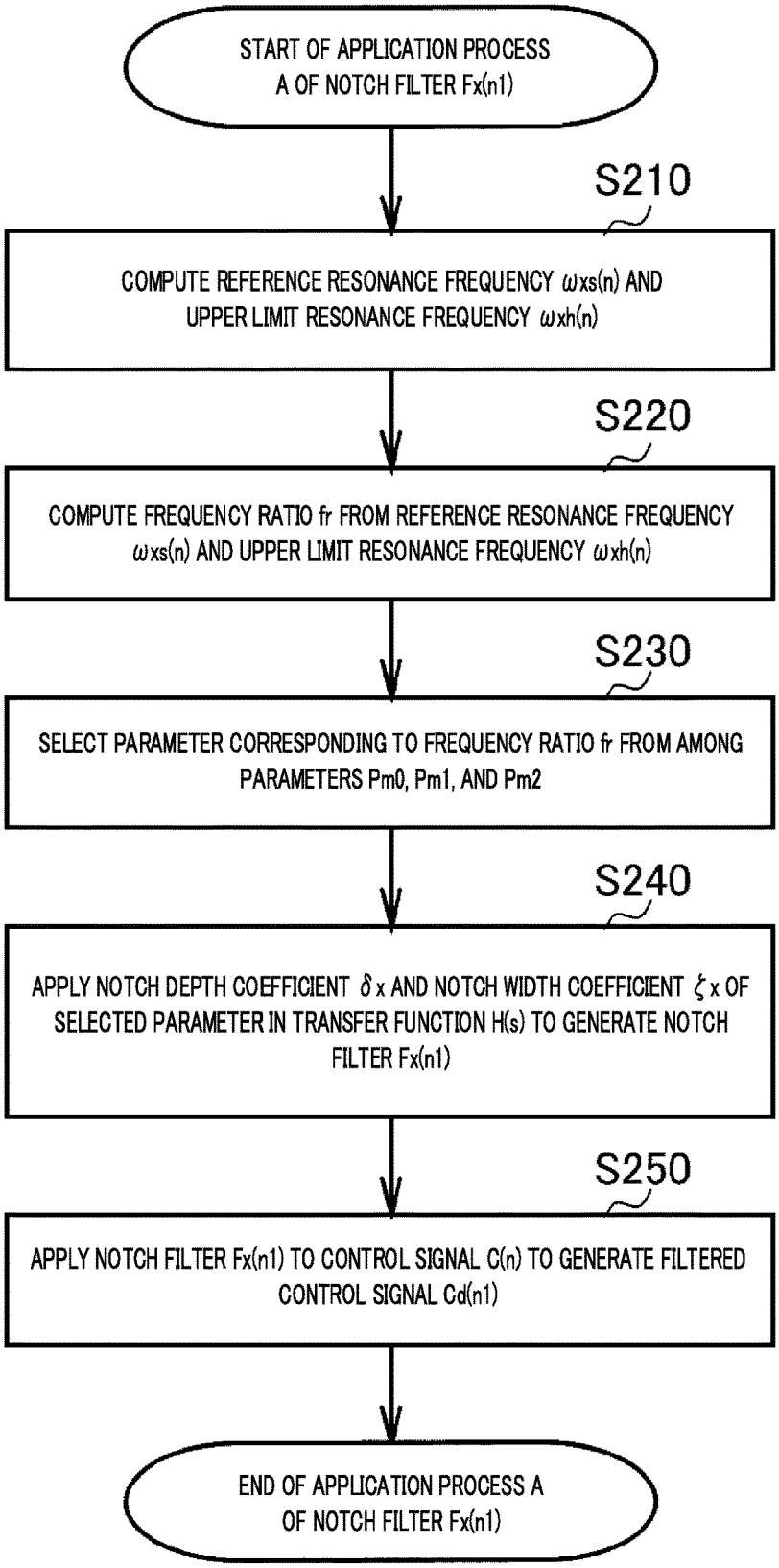
FIG. 11 is a flowchart indicating a process of applying the notch filter in manipulation of a single manipulation tool alone in the vibration control.

Control device 33 starts application process A of applying notch filter Fx(n1) at step S200, and proceeds to step S210 (see FIG. 11). Then, after application process A of applying notch filter Fx(n1) is ended, control device 33 proceeds to step S130 (see FIG. 10).

As illustrated in FIG. 10, control device 33 determines at step S130 whether or not the emergency stop manipulation with a manipulation tool in a specific manipulation procedure is being performed.

When a result of the determination indicates that the emergency stop manipulation with the manipulation tool in the specific manipulation procedure is being performed (that is, when control signal C(ne) for the emergency stop manipulation is generated), control device 33 proceeds to step S140.

On the other hand, when the emergency stop manipulation with the manipulation tool in the specific manipulation procedure is not being performed (that is, when control signal C(ne) for the emergency stop manipulation is not generated), control device 33 proceeds to step S150.

Control device 33 generates control signal C(ne) for the emergency manipulation according to the emergency stop manipulation at step S140. That is, control device 33 generates control signal C(ne) to which neither notch filter Fx(n1) nor notch filter Fx(n2) is applied, and proceeds to step S150.

Control device 33 transmits the generated filtered control signal to a manipulation valve corresponding to the generated filtered control signal at step S150, and proceeds to step S110. Alternatively, when control signal C(ne) for the emergency stop manipulation is generated, control device 33 transmits only control signal C(ne) for the emergency stop manipulation to the corresponding manipulation valve, and proceeds to step S110.

Control device 33 determines at step S160 whether or not the automatic control is being carried out.

When a result of the determination indicates that the automatic control is being carried out, control device 33 proceeds to step S300.

On the other hand, when the automatic control is not being carried out (that is, when none of control signal C(n) of the manual control and control signal C(na) of the automatic control are generated), control device 33 proceeds to step S110.

Figure 12:
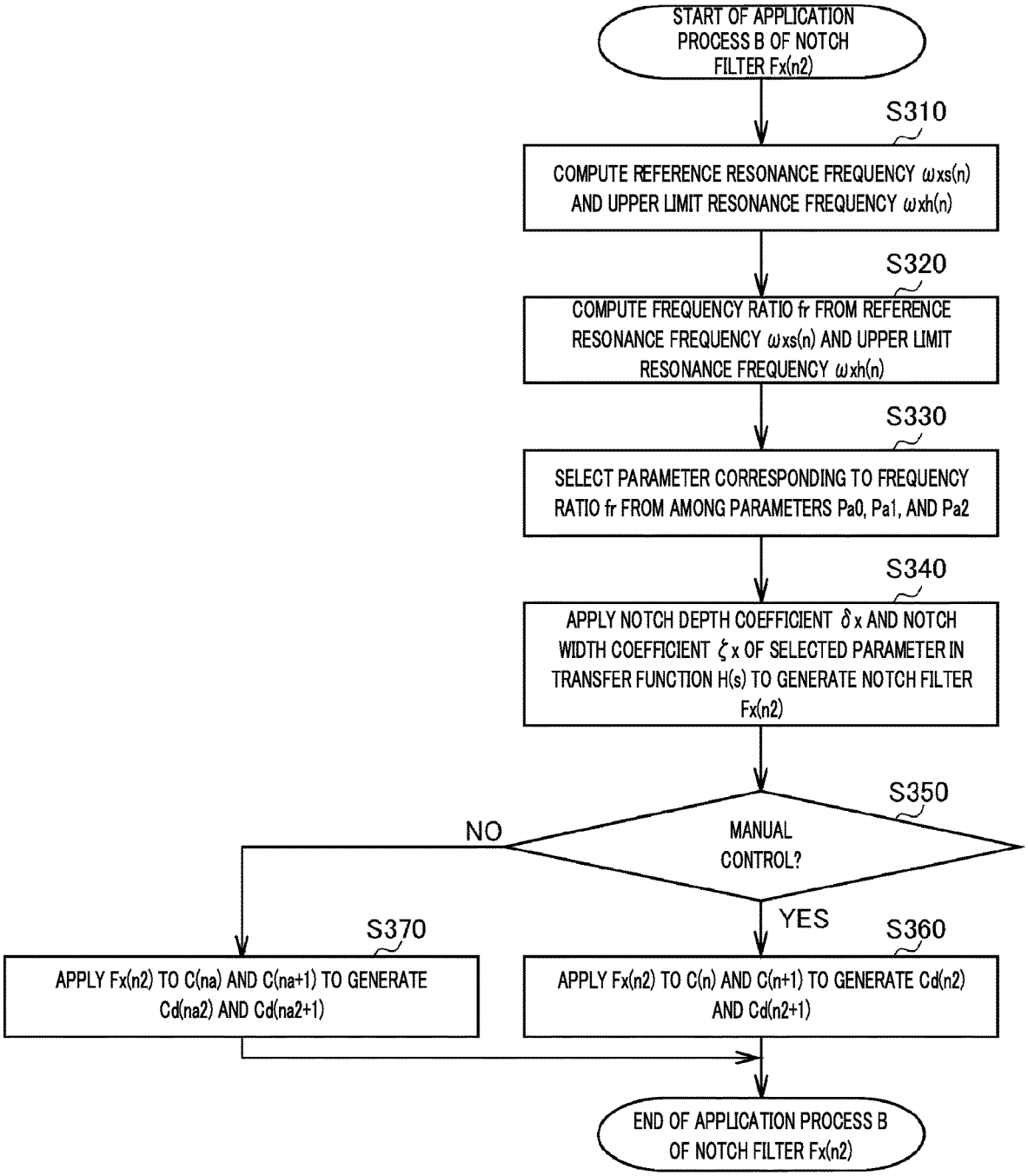
FIG. 12 is a flowchart indicating a process of applying the notch filter in independent manipulation of a plurality of manipulation tools in the vibration control.

Control device 33 starts application process B of applying notch filter Fx(n2) at step S300, and proceeds to step S310 (see FIG. 12). Then, after application process B of applying notch filter Fx(n2) is ended, control device 33 proceeds to step S130 (see FIG. 10).

As illustrated in FIG. 11, control device 33 computes reference resonance frequency ωxs(n) from the sum of obtained suspension length Ls(n) and average sling length Lw(n) stored in advance, and computes upper limit resonance frequency ωxh(n) from suspension length Ls(n) and shortest sling length Lws(n) stored in advance at step S210 of application process A of applying notch filter Fx(n1), and then proceeds to step S220.

Control device 33 computes frequency ratio fr from computed reference resonance frequency ωxs(n) and upper limit resonance frequency ωxh(n) at step S220, and proceeds to step S230.

Control device 33 selects a parameter corresponding to computed frequency ratio fr from among parameters Pm0, Pm1, and Pm2 at step S230, and proceeds to step S240.

Control device 33 applies notch depth coefficient δx and notch width coefficient of the selected parameter to transfer function H(s) (see Equation 2) to generate notch filter Fx(n1) at step S240, and proceeds to step S250.

Control device 33 applies notch filter Fx(n1) to control signal C(n) to generate filtered control signal Cd(n1) corresponding to control signal C(n) at step S250, ends application process A of applying notch filter Fx(n1), and proceeds to step S130 (see FIG. 10).

As illustrated in FIG. 12, control device 33 computes reference resonance frequency ωxs(n) from the sum of obtained suspension length Ls(n) and average sling length Lw(n) stored in advance, and computes upper limit resonance frequency ωxh(n) from suspension length Ls(n) and shortest sling length Lws(n) stored in advance at step S310 of application process B of applying notch filter Fx(n2), and then proceeds to step S320.

Control device 33 computes frequency ratio fr from computed reference resonance frequency ωxs(n) and upper limit resonance frequency ωxh(n) at step S320, and proceeds to step S330.

Control device 33 selects a parameter corresponding to computed frequency ratio fr from among parameters Pa0, Pa1, and Pa2 at step S330, and proceeds to step S340.

Control device 33 applies notch depth coefficient δx and notch width coefficient ζx of the selected parameter to transfer function H(s) (see Equation 2) to generate notch filter Fx(n2) at step S340, and proceeds to step S350.

Control device 33 determines at step S350 whether or not the manual control is being carried out.

When a result of the determination indicates that the manual control is being carried out, control device 33 proceeds to step S360.

On the other hand, when the manual control is not being carried out, control device 33 proceeds to step S370.

Control device 33 applies notch filter Fx(n2) to control signal C(n) according to a single manipulation tool and control signal C(n+1) according to another manipulation tool to generate filtered control signal Cd(n2) corresponding to control signal C(n) and filtered control signal Cd(n2+1) corresponding to control signal C(n+1) at step S360, ends application process B of applying notch filter Fx(n2), and proceeds to step S130.

Control device 33 applies notch filter Fx(n2) to control signal C(na) for an automatic control and corresponding to a single manipulation tool and control signal C(na+1) for the automatic control and corresponding to another manipulation tool, so as to generate filtered control signal Cd(na2) corresponding to control signal C(na) and filtered control signal Cd(na2+1) corresponding to control signal C(na+1) at step S370, ends application process B of applying notch filter Fx(n2), and proceeds to step S130 (see FIG. 10).

As described above, in crane 1, notch filter Fx(n) having appropriate notch width Bn and notch depth Dn is set according to frequency ratio fr even when frequency ratio fr between upper limit resonance frequency ωxh(n), which varies depending on variations of the sling wire rope, and center frequency ωc(n) of notch filter Fx(n) fluctuates depending on suspension length Ls(n) of the sub wire rope. Further, crane 1 carries out the vibration control with an enhanced vibration reducing effect when a plurality of manipulation tools are simultaneously manipulated in the manual control. Moreover, crane 1 carries out the vibration control with an enhanced vibration reducing effect in automatic controls including an automatic stop control, an automatic carriage control, and/or the like in accordance with restrictions of a working region. In addition, when the emergency stop signal is generated by manipulation with a manipulation tool, switching to the vibration control for prioritizing the manipulability takes place. That is, crane 1 is configured such that control device 33 selectively switches notch filter Fx(n) applied to control signal C(n) depending on the manipulation state of the manipulation tool. Crane 1 can thus effectively reduce, depending on the operational state of crane 1, the vibration that is caused in load W and is related to the resonance frequency of the pendulum based on suspension length L(n) of the wire rope.

In the vibration control according to the present invention, a composite frequency of a natural vibration frequency excited when each of the structural components constituting crane 1 is vibrated by an external force and resonance frequency ωx(n) is used as reference center frequency ωc(n) of notch filter Fx(n1) and notch filter Fx(n2) applied to control signal C(n), so that it is possible to reduce together not only a vibration at resonance frequency ωx(n) but also a vibration at the natural vibration frequency that each of the structural components of crane 1 has. Here, the natural vibration frequency excited when each of the structural components constituting crane 1 is vibrated by an external force means a natural frequency, such as the natural frequency of telescopic boom 9 in the luffing direction or in the swiveling direction, the natural frequency of telescopic boom 9 due to its axial distortion, the resonance frequency of the double pendulum composed of main hook block 10 or sub hook block 11 and a sling wire rope, the natural frequency of main wire rope 14 or sub wire rope 16 caused when the wire rope stretches to generate a stretch vibration, or the like.

In the present embodiment, average sling length Lw(n), longest sling length Lwl(n), and shortest sling length Lws(n) are computed from a single normal distribution in which all use states are collected. However, the use states may also be classified depending on applications of crane 1 and/or the types of load W, so as to compute average sling length Lw(n), longest sling length Lwl(n), and shortest sling length Lws(n) for each classification such that those lengths in each classification follow normal distributions.

Further, in the present embodiment, parameters Pm0, Pm1, and Pm2 and parameters Pa0, Pa1, and Pa2 are set such that an inertially-driven amount caused when notch filter Fx(n) is applied is substantially the same for same suspension length Ls(n). However, parameters Pm0, Pm1, and Pm2 and parameters Pa0, Pa1, and Pa2 may also be set such that the inertially-driven amount remains substantially the same even when suspension lengths Ls(n) changes. In addition, although notch width coefficient ζx and notch depth coefficient δx are set by selecting one of the parameters depending on frequency ratio fr, notch width coefficient ζx and notch depth coefficient δx may also be changed continuously according to frequency ratio fr.

The embodiment described above showed only a typical form, and can be variously modified and carried out within the range without deviation from the main point of one embodiment. Further, it is needless to say that the present invention can be carried out in various forms, and the scope of the present invention is indicated by the descriptions of the claims, and includes the equivalent meanings of the descriptions of the claims and every change within the scope.

INDUSTRIAL APPLICABILITY

The present invention can be utilized for cranes that attenuate a resonance frequency component of a control signal.

REFERENCE SIGNS LIST

1 Crane
8 Hydraulic swivel motor
12 Hydraulic luffing cylinder
14 Main wire rope
16 Sub wire rope
18 Swivel manipulation tool
19 Luffing manipulation tool
33 Control device
L(n) Suspension length of wire rope
ωx(n) Resonance frequency
ωxs(n) Reference resonance frequency
ωxh(n) Upper limit resonance frequency
Lw(n) Average sling length
Lws(n) Shortest sling length
fr Frequency ratio
C(n) Control signal
Cd(n) Filtered control signal

The invention claimed is:

1. A working machine that hoists a load using a sling wire rope suspended by a hook at an end of a wire rope, the working machine comprising:

a detection section that detects a let-out length of the wire rope;

a control section including a resonance-frequency computation section that computes a resonance frequency of a swing of the load based on a sum of a suspension length of the wire rope and a sling length of the sling wire rope; and a filter section that generates a filtered control signal by attenuating a basic control signal of an actuator of a boom in a frequency range of a frequency component to be attenuated and at a rate of attenuation with reference to the resonance frequency, the frequency range of the frequency component to be attenuated and the rate of attenuation being computed based on the suspension length and the sling length, wherein the control section controls a manipulation amount of luffing, swiveling, extension, or retraction of the boom by using the filtered control signal, wherein the resonance-frequency computation section obtains an average value and a minimum value of the sling length based on past measurement values, computes a reference resonance frequency of the swing of the load computed from a sum of the suspension length and the average value of the sling length, and computes an upper limit resonance frequency of the swing of the load computed from a sum of the suspension length and the minimum value of the sling length, and wherein the control section computes the frequency range of the frequency component to be attenuated and the rate of attenuation depending on the suspension length and a ratio of the upper limit resonance frequency to the reference resonance frequency.

2. The working machine according to claim 1, wherein the sling length is a length of from a hook position of the wire rope to a position of a center of gravity of the load.

3. The working machine according to claim 1, wherein the sling length is an average value of sling lengths.

4. A working machine that hoists a load using a sling wire rope suspended by a hook at an end of a wire rope, the working machine comprising:

a detection section that detects a let-out length of the wire rope;

a control section including a resonance-frequency computation section that computes a resonance frequency of a swing of the load based on a sum of a suspension length of the wire rope and a sling length of the sling wire rope; and a filter section generates a filtered control signal by attenuating a basic control signal of an actuator of a boom in a frequency range of a frequency component to be attenuated and at a rate of attenuation with reference to the resonance frequency, the frequency range of the frequency component to be attenuated and the rate of attenuation being computed based on the suspension length and the sling length, wherein the control section controls a manipulation amount of luffing, swiveling, extension, or retraction of the boom by using the filtered control signal, and wherein the control section makes the frequency range of the frequency component to be attenuated and the rate of attenuation different between a manual control and an automatic control of the working machine.

5. A working machine that hoists a load using a sling wire rope suspended by a hook at an end of a wire rope, the working machine comprising:

a detection section that detects a let-out length of the wire rope;

a control section including a resonance-frequency computation section that computes a resonance frequency of a swing of the load based on a sum of a suspension length of the wire rope and a sling length of the sling wire rope; and a filter section generates a filtered control signal by attenuating a basic control signal of an actuator of a boom in a frequency range of a frequency component to be attenuated and at a rate of attenuation with reference to the resonance frequency, the frequency range of the frequency component to be attenuated and the rate of attenuation being computed based on the suspension length and the sling length, wherein the control section controls a manipulation amount of luffing, swiveling, extension, or retraction of the boom by using the filtered control signal, and wherein the control section computes a composite frequency resulting from combination of the resonance frequency and a natural vibration frequency excited when a structural component constituting the working machine is vibrated by an external force, and generates the filtered control signal in which the frequency component is attenuated in the frequency range at the rate with reference to the composite frequency.

6. A method for a working machine that hoists a load using a sling wire rope suspended by a hook at an end of a wire rope, the method comprising:

computing a resonance frequency of a swing of the load based on a sum of a suspension length of the wire rope and a sling length of the sling wire rope;

computing a frequency range of a frequency component to be attenuated and a rate of attenuation based on the suspension length and the sling length; and generating a filtered control signal by attenuating the frequency component of a basic control signal of an actuator in the frequency range at the rate with reference to the resonance frequency, wherein the computing a resonance frequency of a swing of the load comprises:

obtaining an average value and a minimum value of the sling length based on past measurement values, computing a reference resonance frequency of the swing of the load computed from a sum of the suspension length and the average value of the sling length, computing an upper limit resonance frequency of the swing of the load computed from a sum of the suspension length and the minimum value of the sling length, and computing the frequency range of the frequency component to be attenuated and the rate of attenuation depending on the suspension length and a ratio of the upper limit resonance frequency to the reference resonance frequency.

* * * * *